US006997288B2

(12) United States Patent
Kakko et al.

(10) Patent No.: US 6,997,288 B2
(45) Date of Patent: Feb. 14, 2006

(54) FLOOR NUMBER DISPLAY AT LANDING AND IN CAR, INFORMATIVE TO ELEVATOR PASSENGERS

(75) Inventors: Markku Kakko, Hyvinkää (FI); Pentti Laihanen, Hyvinkää (FI); Johannes De Jong, Järvenpää (FI); Rauno Hatakka, Riihimäki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/756,379

(22) Filed: Jan. 14, 2004

(65) Prior Publication Data

US 2004/0226777 A1 Nov. 18, 2004

Related U.S. Application Data

(63) Continuation of application No. PCT/FI02/00661, filed on Aug. 12, 2002.

(30) Foreign Application Priority Data

Aug. 14, 2001 (FI) ..... 20011637

(51) Int. Cl.
*B66B 1/34* (2006.01)

(52) U.S. Cl. ..... 187/391; 187/396

(58) Field of Classification Search ..... 187/391–396, 187/901, 902, 282, 286
See application file for complete search history.

(56) References Cited

U.S. PATENT DOCUMENTS

| | | | | | |
|---|---|---|---|---|---|
| 4,032,882 | A | * | 6/1977 | Mandel et al. | 187/398 |
| 4,149,614 | A | * | 4/1979 | Mandel et al. | 187/397 |
| 5,300,738 | A | * | 4/1994 | Kostka et al. | 187/395 |
| 5,485,897 | A | * | 1/1996 | Matsumoto et al. | 187/399 |
| 5,689,094 | A | * | 11/1997 | Friedli et al. | 187/384 |
| 6,062,346 | A | * | 5/2000 | Friedli et al. | 187/395 |
| 6,065,570 | A | * | 5/2000 | Friedli et al. | 187/387 |
| 6,394,231 | B1 | * | 5/2002 | Schuster et al. | 187/382 |
| 6,550,587 | B1 | * | 4/2003 | Yuasa et al. | 187/394 |
| 2003/0164267 | A1 | * | 9/2003 | Hikita | 187/391 |

FOREIGN PATENT DOCUMENTS

| | | | | |
|---|---|---|---|---|
| FR | 2 671 335 | A1 | | 7/1992 |
| JP | 02225272 | A | * | 9/1990 |
| JP | 2-291376 | A | | 12/1990 |
| JP | 3-31178 | A | | 2/1991 |
| JP | 4-169484 | A | | 6/1992 |
| JP | 04256672 | A | * | 9/1992 |
| JP | 05201633 | A | * | 8/1993 |
| JP | 8-337367 | A | | 12/1996 |

* cited by examiner

*Primary Examiner*—Jonathan Salata
(74) *Attorney, Agent, or Firm*—Birch, Stewart, Kolasch & Birch, LLP

(57) ABSTRACT

Floor number displays informative to the elevator passengers at the landing and in the elevator car when the passengers issue destination calls to the elevator.

7 Claims, 3 Drawing Sheets

FLOOR NUMBER DISPLAY AT LANDING AND IN CAR, INFORMATIVE TO ELEVATOR PASSENGERS

This application is a Continuation of copending PCT International Application No. PCT/FI02/00661 filed on Aug. 12, 2002, which designated the United States, and on which priority is claimed under 35 U.S.C. §120, and this Nonprovisional application claims priority under 35 U.S.C. §119(a) on Patent Application No(s). 20011637 filed in Finland on Aug. 14, 2001, the entire contents of which are hereby incorporated by reference.

FIELD OF THE INVENTION

The present invention relates to a floor number display at landing and in car, informative to the passenger.

DESCRIPTION OF THE RELATED ART

A common problem with floor number display solutions showing destination calls is that, at the starting floor and in the car, the elevator passenger cannot obtain from the floor number displays sufficiently informative information regarding destination calls entered. This may lead to a situation where an elevator passenger cannot decide when to leave the car and therefore rides past his/her destination floor. On the other hand, he/she may also choose the wrong elevator already at the starting floor.

BRIEF SUMMARY OF THE INVENTION

The object of the invention is to eliminate the drawbacks encountered in prior-art solutions referred to above.

According to the invention, via the floor number display informative to the passenger, the destination floors are displayed to the elevator passenger at the passenger's starting floor and in the car in different ways as compared with each other, when the elevator passenger issues destination calls to the elevator.

In more precise terms, the floor number display at landing and in car is informative to the passenger according to the invention is characterized by what is presented in the characterization part of claim 1. The features characteristic of certain preferred embodiments of the invention are presented in the subclaims.

The floor number display of the invention, which is as informative as possible to the elevator passenger both at the landing and in the car, provides significant advantages as compared with prior art.

In a preferable case, the floor number display according to the present the invention shows fewer calls to be displayed. Therefore, the elevator passenger can more readily distinguish his/her own destination floor among the other calls shown on the floor number display. The floor number display of the invention serves as expediently as possible both elevator passengers waiting for an elevator in an elevator lobby and elevator passengers already in an elevator car.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail with reference to the attached drawings, which are given by way of illustration only, and thus are not limitative of the present invention, and wherein.

DETAILED DESCRIPTION OF THE INVENTION

The invention concerns a floor number display 1, 2 informative to the elevator passenger at the landing and in the car when the passenger issues destination calls to the elevator. According to the most preferred embodiment of the invention, on the aforesaid floor number displays 1, 2, 3, destination floors are shown in different ways at the elevator passenger's starting floor and in the car as compared with each other.

Figure 1A:
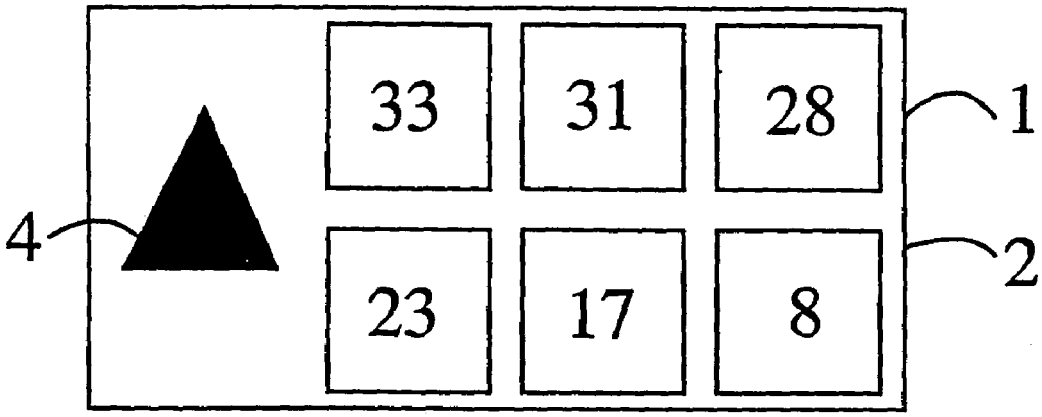
FIG. 1*a* presents a floor number display according to the invention, located at the starting floor of an elevator passenger.

FIG. 1*a* presents a floor number display 1 according to the invention, placed at the elevator passenger's starting floor. According to an embodiment of the present invention, the aforesaid floor number display 1 at the elevator passenger's starting floor displays destination calls issued from the aforesaid floor and allocated to the aforesaid elevator from the aforesaid floor onward. The floor number display 1, which is placed in the elevator lobby, also comprises an arrow 4 indicating traveling direction.

Figure 1B:
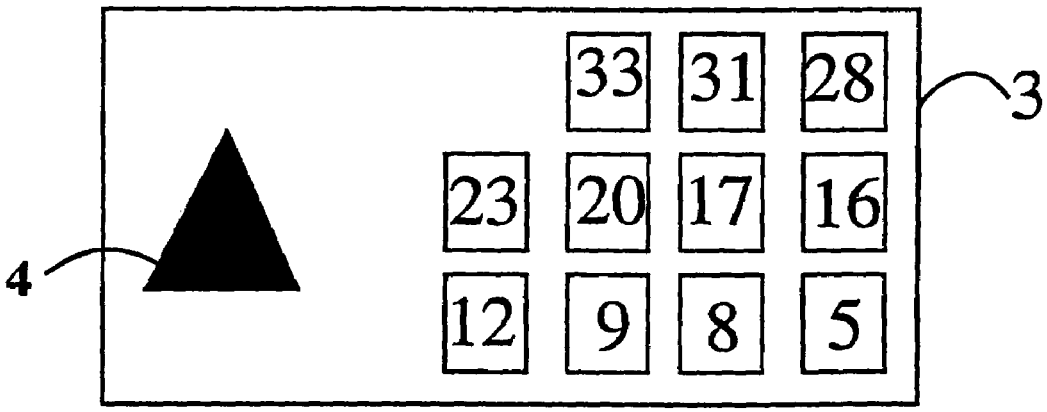
FIG. 1*b* presents a floor number display according to the invention placed in an elevator car.

FIG. 1*b* presents a floor number display 3 according to the invention in an elevator car. Via the floor number display 2 of the invention in the car, while the elevator door is open, passengers standing at the landing outside the elevator car and intending to enter the car are shown the same information as via the aforesaid floor number display 1 at the elevator passenger's starting floor.

According to the present invention, via the aforesaid floor number display 3 in the car, the destination calls allocated to the aforesaid elevator are displayed to the elevator passengers in the car. In other words, the aforesaid floor number display 3 in the car is used to show the stops needed to admit passengers as well as the stops associated with the destination floor. On the aforesaid floor number display 3, all destination floors allocated to the car in question are displayed in the order of stops. Thus, the elevator passenger can easily and clearly discern which destination floor will be the next one and when the elevator will reach the passenger's own destination floor.

In addition, the floor number displays 2, 3 placed in the car also comprise an arrow indicating the traveling direction.

According to the invention, the floor number display 3 placed in the elevator car and showing the destination floor to the elevator passengers changes the information shown on the display according to the floor for each stop separately.

Thus, after each stop, this aforesaid floor number display 2 placed in the car and permitting the floor numbers to be seen from the lobby updates the destination floors shown on the display. In other words, the aforesaid floor number display 2 placed in the car and permitting the floor numbers to be seen from the elevator lobby changes the floor number data displayed at each stopping floor according to what is displayed by the floor number display 1 in the elevator lobby on the stopping floor in question.

Figure 2:
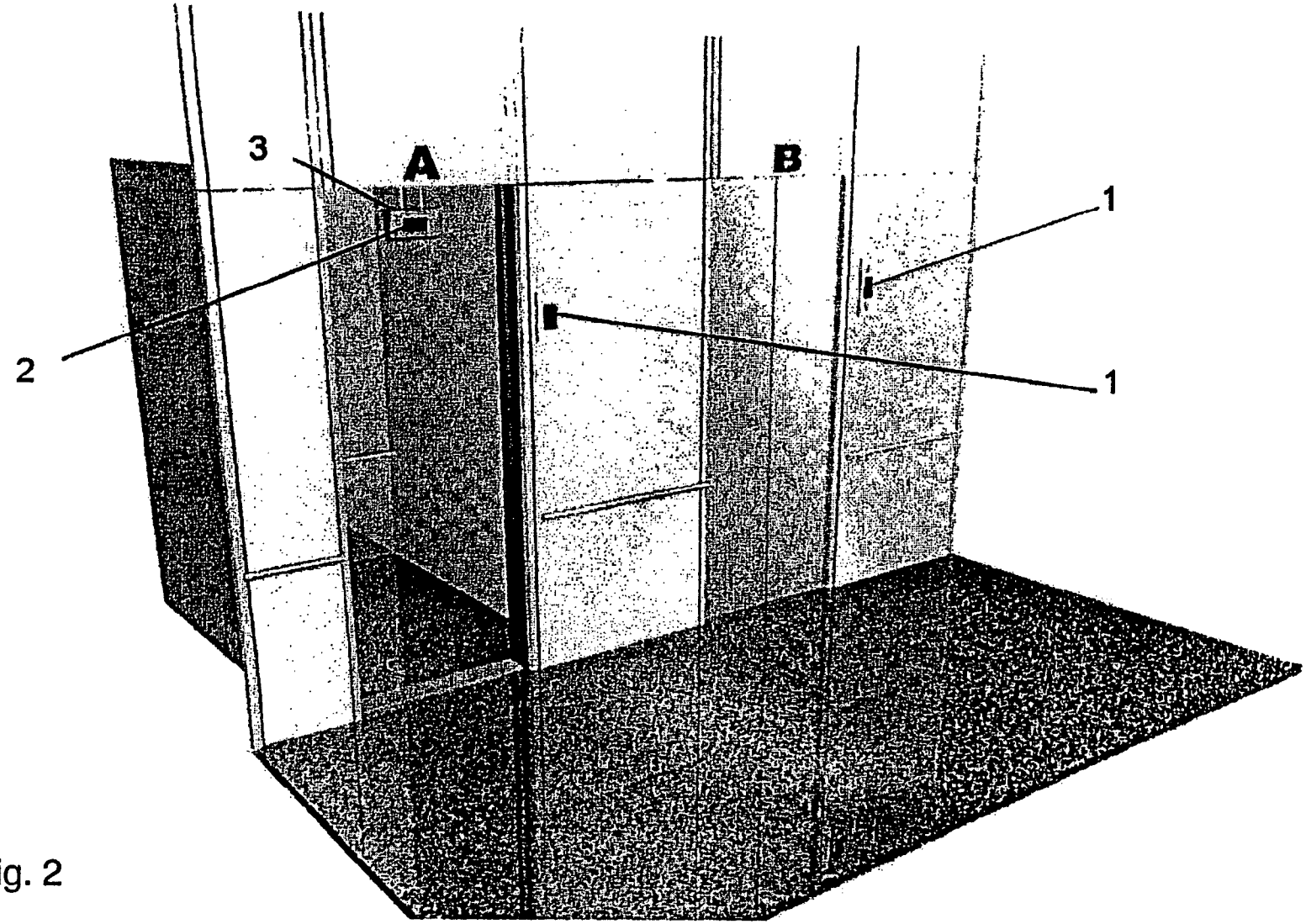
FIG. 2 shows how the floor number displays of the invention are disposed in the elevator lobby and in the car.

FIG. 2 illustrates the disposition of floor number displays 1, 2, 3 according to the invention in the elevator lobby and in the car. As shown in the figure, the floor number display 1 of the invention at the elevator passenger's starting floor is so disposed in the elevator lobby that the aforesaid floor number display 1 beside each elevator indicates the destination floors allocated to the elevator in question. The floor number displays 2, 3 placed inside the elevator car and displaying information to the passengers are disposed in the upper part of the elevator car. Moreover, the aforesaid floor number display 2, 3 placed inside the elevator car is a two-sided display such that, when the elevator door is open, it displays to passengers on the landing the same destination floor information as is displayed by the floor number display 1 placed in the elevator lobby on the elevator passenger's starting floor. Via floor number display 3, car call information is displayed toward the passengers inside the car as illustrated in FIG. 1*b*.

In the foregoing, the invention has been described by way of example by the aid of the attached drawings while different embodiments of the invention are possible within the scope of the inventive idea defined in the claims.

Figure 3:
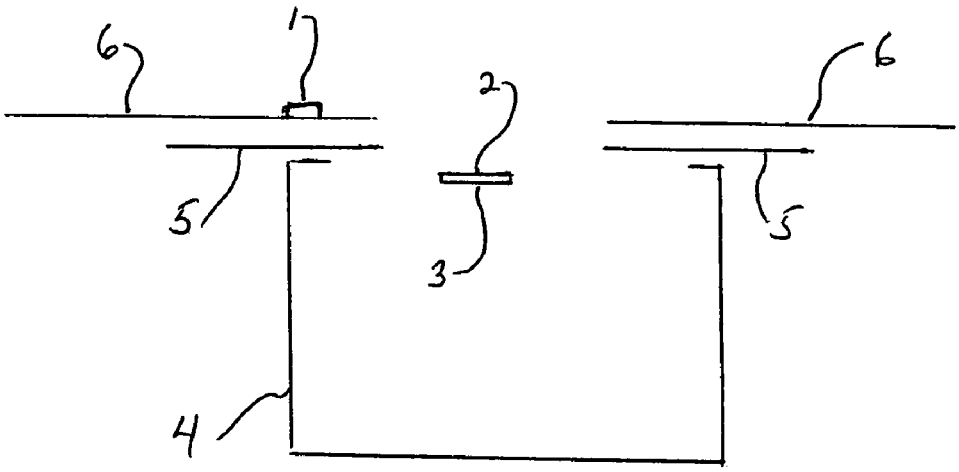
FIG. 3 shows a top view of an elevator car including the floor number displays according the present invention.

FIG. 3 illustrates the arrangement of the floor number displays using a top view of the elevator car 4. The car includes doors 5 which are open. The lobby includes walls 6 having an opening aligned with the opening in the doors 5. The elevator car includes displays 2 and 3 facing in opposite directions. These displays are on opposite sides of a support which hangs down from the ceiling or other structure of the elevator car. The display 2 is arranged to face toward the lobby through the open doors so as to be visible by one standing in the lobby and looking into the car. The display 3 is arranged so as to face inside the car so as to be visible by people standing within the car. Display 1, which shows the same information as display 2, is placed on the lobby wall.

What is claimed is:

1. Floor number displays which inform an elevator passenger at a landing and in an elevator car comprising:

a first floor number display at an elevator passenger's starting floor, the first floor number display being in an elevator lobby beside each elevator to indicate destination floors allocated to the elevator car adjacent the first floor number display;

a second floor number display at an upper part of the elevator car displaying information from the elevator car to the landing floor at which the elevator car is located when a door of the elevator car is open, the information on the second floor number display matching information on the first floor number display which is adjacent the elevator; and a third floor number display at an upper part of the elevator car displaying information to passengers within the elevator car, the information displayed by the third floor number display being floors for the elevator car selected by the passengers in that car as well as the destination floors allocated to the elevator car as displayed in said first and second floor number displays.

2. The floor number displays according to claim 1, wherein the second floor number display is in front of the third floor number display.

3. The floor number displays according to claim 1, wherein the first floor number display displays destination calls issued from the floor and allocated to the elevator from the floor onward.

4. The floor number displays according to claim 1, wherein the third floor number display shows to the elevator passengers within the elevator car destination calls allocated to the elevator car.

5. The floor number displays according to claim 1, wherein after each stop of the elevator car, the second floor number display updates displayed destination floors.

6. The floor number displays according to claim 1, wherein the second and third floor number displays are two-sided displays placed in the elevator car.

7. The floor number displays according to claim 1, wherein each floor number display includes an arrow indicating traveling direction.

* * * * *